US005265554A

United States Patent [19]

Meredith

[11] Patent Number: 5,265,554

[45] Date of Patent: Nov. 30, 1993

[54] BOAT CONSTRUCTION

[75] Inventor: Wilbur R. Meredith, Chesterland, Ohio

[73] Assignee: Meredith Marine, Inc., Chesterland, Ohio

[21] Appl. No.: 903,134

[22] Filed: Jun. 23, 1992

[51] Int. Cl.[5] ..... B63B 1/32

[52] U.S. Cl. ..... 114/290

[58] Field of Search ..... 114/290, 283, 65 R, 114/65 A; 71/22, 24, 25

[56] References Cited

U.S. PATENT DOCUMENTS

| | | | |
|---|---|---|---|
| D. 188,148 | 6/1960 | Tritt | 72/356 |
| D. 211,216 | 5/1968 | Whitley | 137/505.33 |
| 2,020,792 | 11/1935 | Maynard et al. | 114/290 |
| 2,369,633 | 2/1945 | Higgins | 114/290 |
| 2,989,939 | 6/1961 | Tatten | 71/22 |
| 3,067,711 | 12/1962 | Hesher et al. | 114/290 |
| 3,376,840 | 4/1968 | Zaphiriou et al. | 114/290 |
| 3,930,455 | 1/1976 | Bremer | 114/290 |
| 4,465,009 | 8/1984 | Wood et al. | 114/290 |
| 4,722,294 | 2/1988 | Bruning | 114/290 |

FOREIGN PATENT DOCUMENTS 498214 1/1939 United Kingdom ..... 114/290

OTHER PUBLICATIONS

Boston Whaler Brochure, p. 5, date unknown.
Johnson Sea-Foil Brochure, 1967.
*Trailer Boats*, "Designer's Viewpoint" Hankinson, p. 22, date unknown.
*Wooden Boat*, "Damned by Faint Praise" Seidmer, May/Jun. 1991, pp. 46-57.

*Primary Examiner*—Jesûs D. Sotelo
*Attorney, Agent, or Firm*—Watts, Hoffmann, Fisher & Heinke Co.

[57] ABSTRACT

A boat is disclosed having a hull with improved operating characteristics. The hull includes a central sponson and outer sponsons on each side of the keel. The sponsons include chines which extend from the transom to the peak of the bow. The chines have ski-like flat portions for providing lift. Between the chines and the keel are a pair of arched tunnels. The chines, the bottom edge of the keel and the gunwales all meet at the peak of the bow. The chines, the keel and the tunnels are all linear and parallel between a mid-section of the hull and the transom.

7 Claims, 8 Drawing Sheets

BOAT CONSTRUCTION

BACKGROUND OF THE INVENTION

1. Field of the Invention

The present invention relates to boats, and more particularly, to boats with hulls having twin tunnels, and three sponsons.

2. Description of Related Art

Power boats have differing operating characteristics depending on the shape of their hulls. Deep-V boat hulls are known for their ability to cut through waves and go relatively fast over rough seas. Deep-V hulls also create a large storage space below deck. However, deep-V hulled boats have a tendency to roll uncomfortably in swells, particularly when turned parallel to the line of waves. Also, boats with deep-V hulls produce a large wake with a heavy spray, displace a great deal of water at all speeds, have a relatively high aerodynamic and hydrodynamic resistance, and generally have poor fuel economy. In rough waters, particularly at high speeds, deep-V hulled boats tend to lift high with each wave and slam downward into the next wave producing an extremely uncomfortable ride.

One reason for the poor efficiency of deep-V hull boats is their tendency to ride at an angle to the water with the bow up high and the stern low. Thus, the hull presents a large frontal surface area to encounter wind and water resistance. In addition, visibility is reduced as a result of the high bow. Some boat designers have attempted to overcome this characteristic by adding trim tabs and/or lifting strakes to the hull; however, these additions cause an increase in drag and add to the cost and maintenance of the boat while reducing fuel economy.

Catamaran-hulled boats, which have two parallel pontoons joined by a thin deck and an open space between them, offer greater lateral stability than deep-V hulled boats. That is, boats having these hulls have less tendency to roll side to side, especially when resting. Also, catamaran-type hulls tend to create a smaller wake, and operate more efficiently. However, catamaran-type boats offer less storage space and engine space. The performance of a catamaran-hulled boat is affected by how much load is being carried to a greater extent than mono-hulled boats. The amount of water displaced is limited by the volume of the pontoons of a catamaran-type boat making the boat sink further in the water than a mono-hulled boat with the same load. Catamaran-hulled boats tend to ride with the bow higher than the stern but ride more level than a deep-V hulled boat. Catamaran-hulled boats will sometimes flip over backwards at high speeds. This effect is believed to be caused by the lifting force of air on the underside of the thin deck when the bow of the boat is high, a condition which occurs frequently in rough seas. Catamaran hulled boats have an inherent structural weakness in that the pontoons acts as large levers stressing the deck. In rough seas, many decks have been broken by such stresses.

A newer type of hull, the tunnel hull, is normally used on racing boats. This hull has a longitudinal air space or "tunnel" along the center of the boat's bottom. On each side of the tunnel are relatively flat-bottomed hull portions. The high relative velocity between the air in the tunnel and the hull tends to stabilize the boat due to the Bernoulli effect and the air cushions the ride causing a smooth hydrofoil-type ride. However, the tunnel in the center of the hull reduces the storage space below deck. Tunnel-hulled boats tend to remain relatively level at higher speeds which reduces aerodynamic and hydrodynamic resistance and increases visibility. The twin flat hull portions lift the boat to reduce drag at higher speeds. Also, tunnel-hulled boats usually produce less wake and spray. Like a catamaran-hulled boat, a tunnel-hulled boats performance is greatly affected by the weight of the load. Tunnel-hulled boats are well-suited to calm waters but produce a rough ride in choppy water.

Optimal power boat performance requires that the propeller or propellers be what is known as "surface piercing" and be located clear of the boat's stern. Surface piercing propellers operate with the drive shaft near the waterline and the bottom half of the propeller in the water and the top half out of the water. In deep-V hulled boats, standard propeller drives are not surface piercing, however, special articulated drives have been developed for deep-V hulled boats which are surface piercing. In catamaran-hulled boats, standard outboard motors placed between the pontoons will be surface piercing if placed at the proper height, however, standard stern drives built into the pontoons, as in deep-V hulls, require special articulated drives to be surface piercing.

There is a demand in the boating industry for a hull which overcomes the shortcomings of existing designs and provides a smooth ride, good fuel economy, greatly reduced wake and spray, good visibility, high stability, strength, ample space below deck and high acceleration. In addition, there is a demand for a boat hull which enables a standard propeller drive to be surface piercing.

SUMMARY OF THE INVENTION

In its broad aspects, the present invention embodies a boat comprising the following: a hull; a bow having a peak; a transom; a pair of gunwales converging at the peak; a generally V-shaped center sponson having a keel extending from the peak to the transom; and a pair of outer sponsons, one to each side of the keel, extending from the peak to the transom. The outer sponsons include a pair of chines which extend from the transom to the peak of the bow where they converge. The hull further includes a pair of arched tunnels, one to each side of the keel. The tunnels extend longitudinally between the peak of the bow and the transom and laterally between the keel and the chines.

In preferred constructions, the inside angle of the center sponson is within the range of 80–100 degrees between the transom and approximately the location where the keel extends from the water. The angle of the inside surface of each outer sponson to the plane of the water is preferably within the range of 25–30 degrees between the transom and a location approximately where the chines extend from the water.

In preferred constructions, each chine has a ski-like flat portion extending between a mid-portion of the hull and the transom. The chines are linear between a point just aft of the mid-portion of the hull and the transom. The keel is linear between the mid-portion of the hyll and the transom.

In the preferred and illustrated embodiment, centerlines of the arched tunnels are parallel between the mid-portion of the hull and the transom and converge at the peak of the bow.

BRIEF DESCRIPTION OF THE DRAWINGS

A preferred embodiment of the invention is shown in the accompanying drawings in which.

DESCRIPTION OF THE PREFERRED EMBODIMENT

Figure 1:
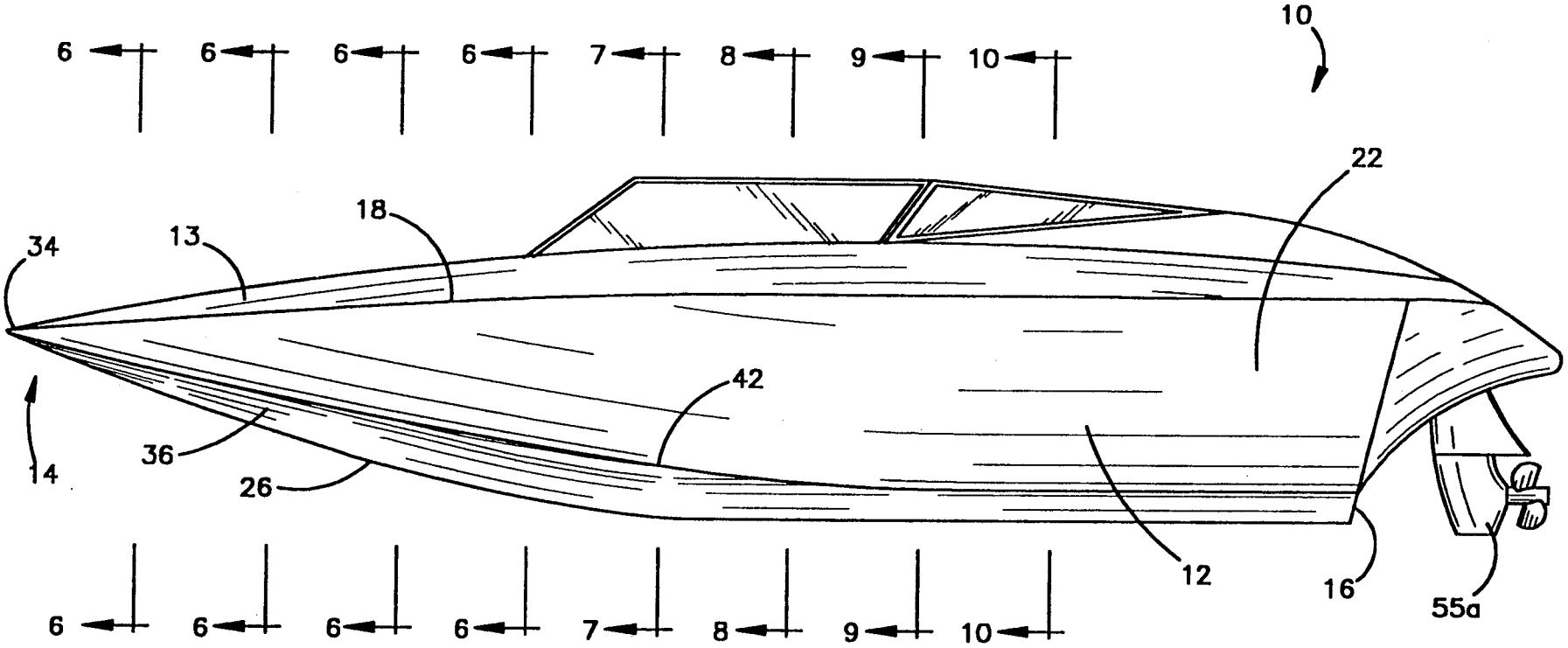
FIG. 1 is a left side elevational view of a boat embodying the present invention.
Figure 2:
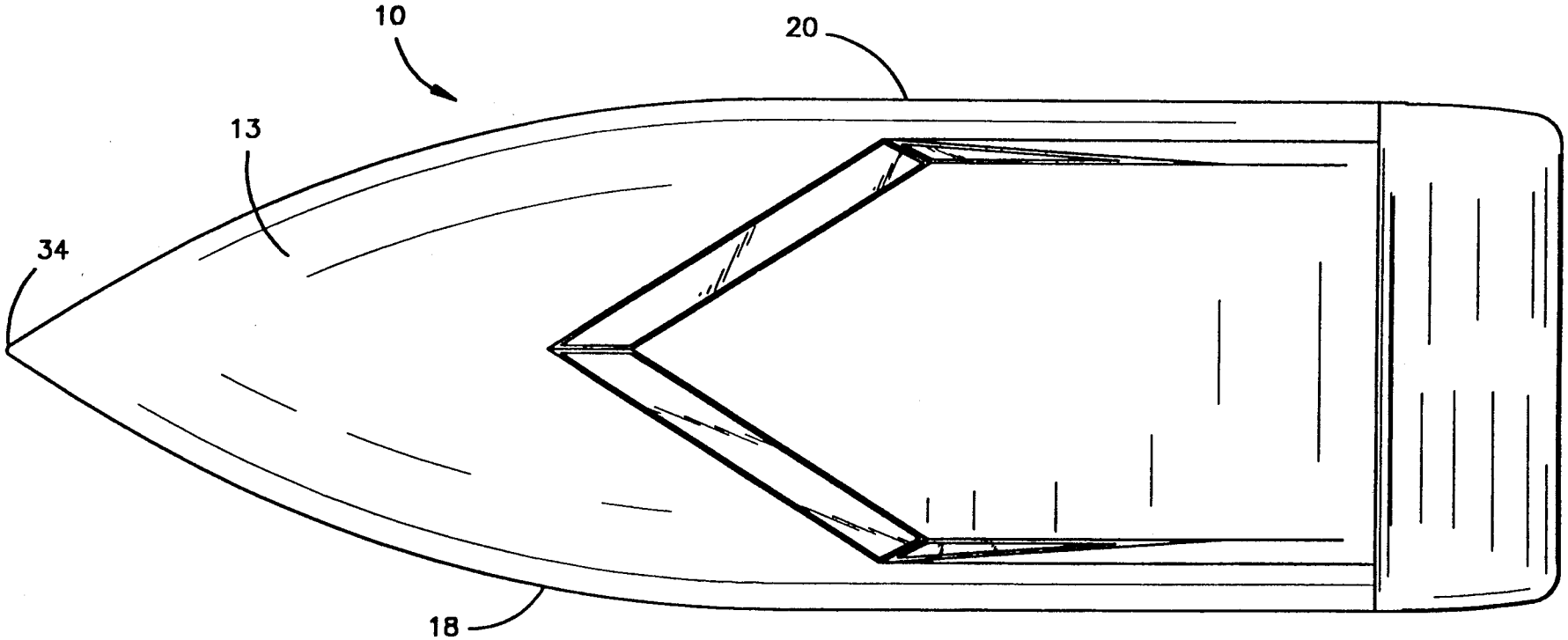
FIG. 2 is a top plan view of the boat of FIG. 1.
Figure 3:
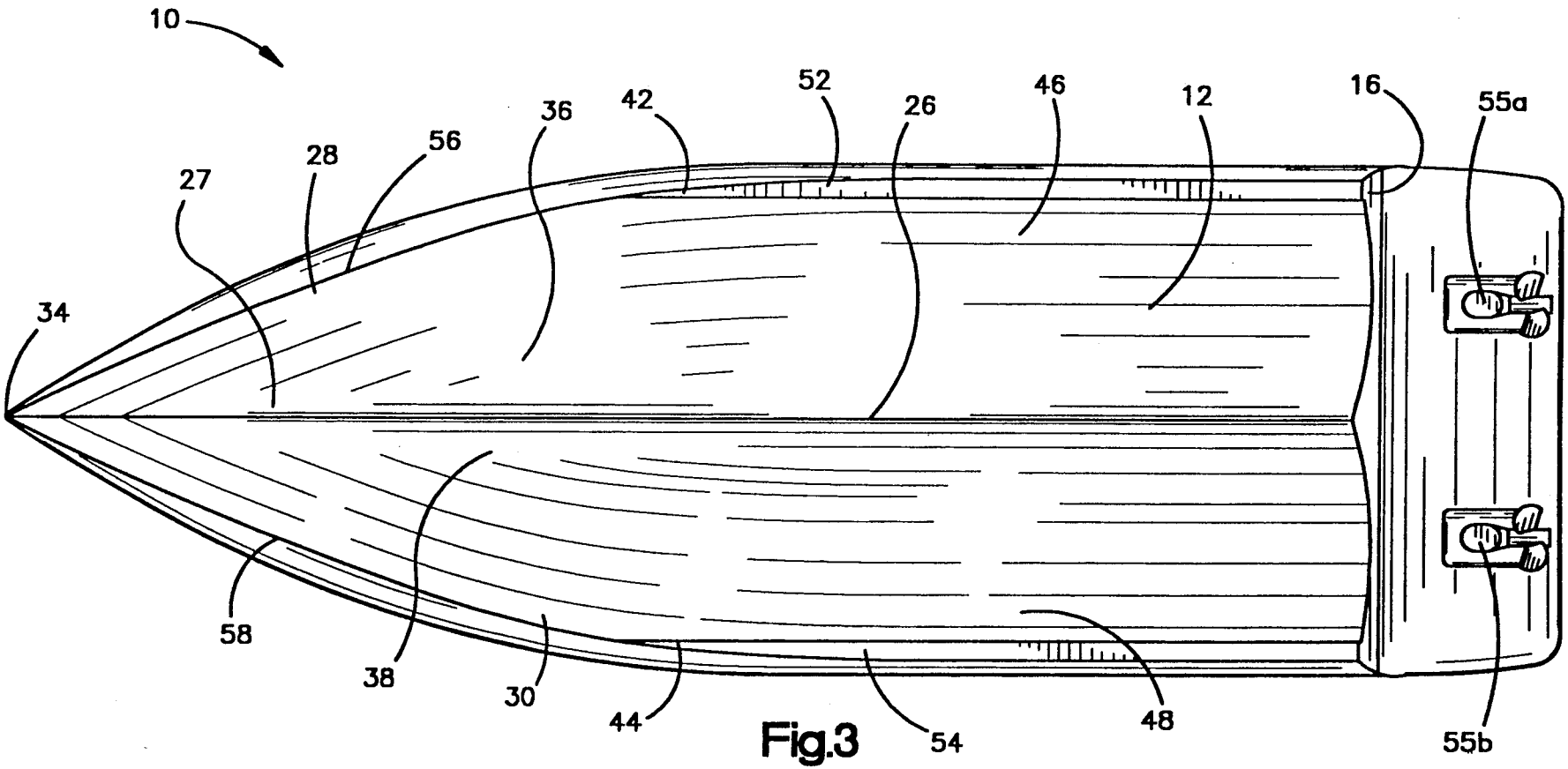
FIG. 3 is a bottom plan view of the boat of FIG. 1.

Referring to FIGS. 1,2, and 3, a boat 10 embodying the present invention is shown having a hull 12 and a deck 13. The hull 12 includes a bow 14, a transom 16, gunwales 18,20, sides 22,24, a keel 26, a center sponson 27, and a pair of parallel outer sponsons 28,30. Proportionally, the overall length of the hull 12 is preferably three times the beam (the breadth at the widest point). The hull 12 is preferably constructed of high quality fiberglass laminates having a balsa core for high strength and light weight.

Figure 4:
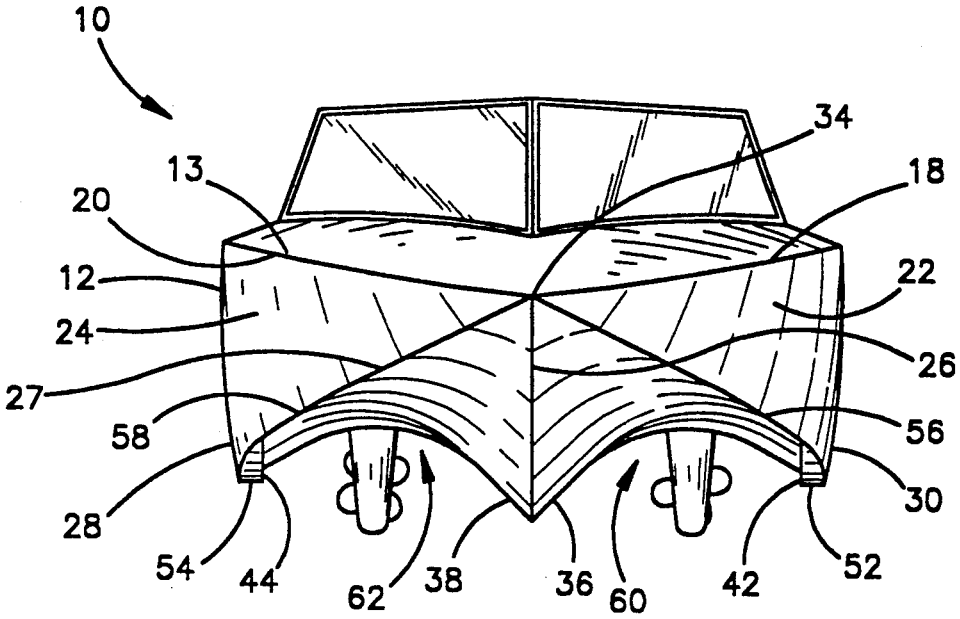
FIG. 4 is a front elevational view of the boat of FIG. 1.
Figure 5:
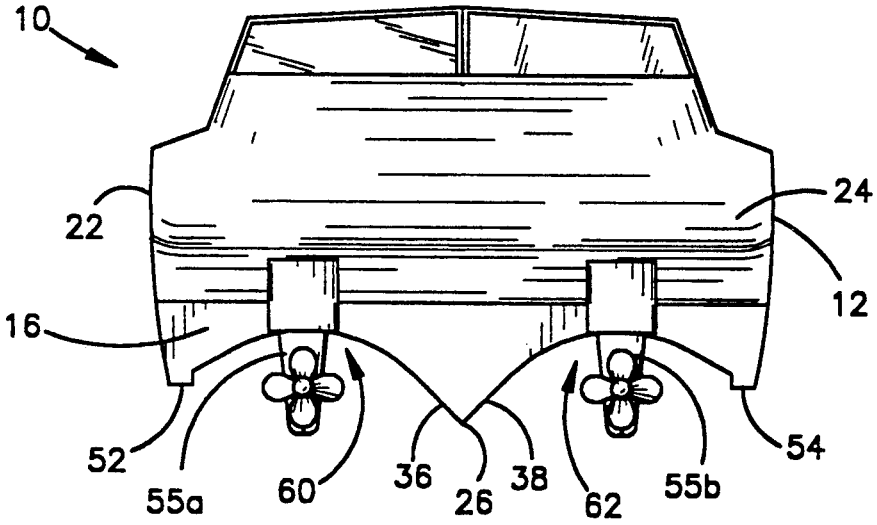
FIG. 5 is a rear elevational view of the boat of FIG. 1.
Figure 12:
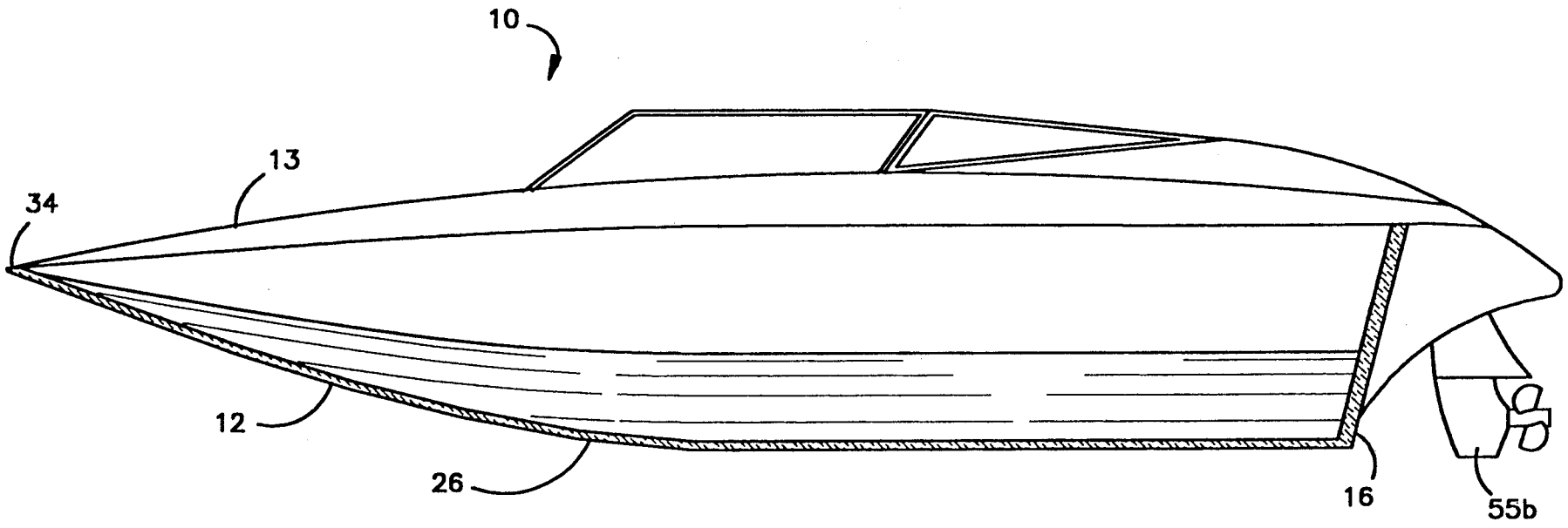
FIG. 12 is a cross sectional view as seen approximately from a plane longitudinally bisecting the boat of FIG. 1.

Referring to FIGS. 4 and 5, the center sponson 27 is a V-shaped structure extending from the bow 14 to the transom 16. The center sponson 27 displaces a great deal of water at slow speeds and at rest permitting a large load to be carried by the boat 10. Referring to FIG. 12, from the midsection of the hull 12 to the transom 16, a bottom edge 32 of the keel 26 is linear. From the midsection forward, the keel's bottom edge 32 slopes upwardly to a peak point 34 at the bow 14.

Figure 7:
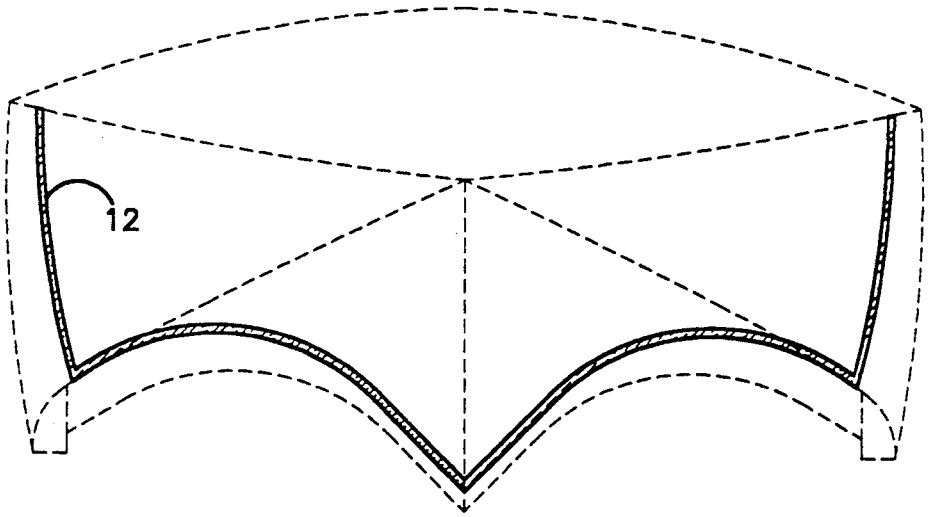
FIG. 7 is a cross sectional view as seen approximately from the plane indicated by the line 7—7 in FIG. 1.
Figure 8:
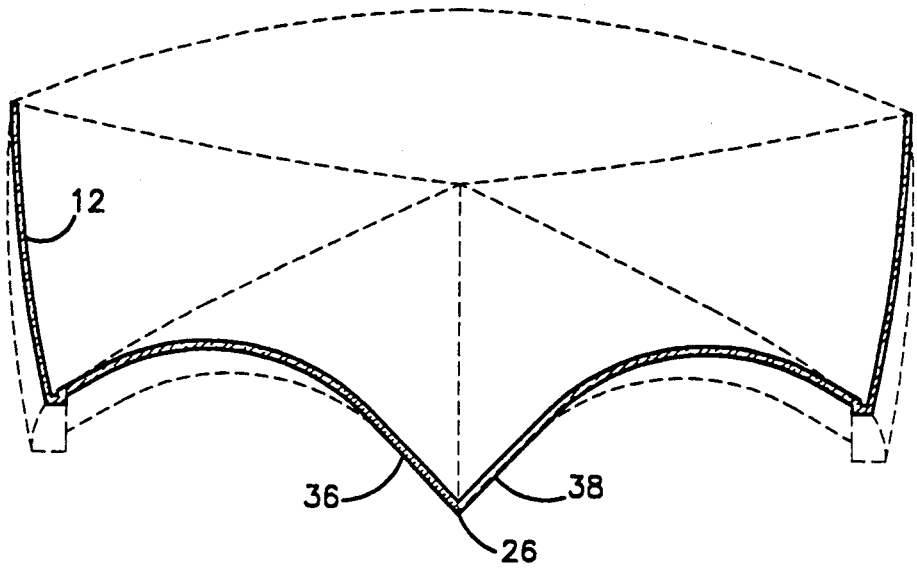
FIG. 8 is a cross sectional view as seen approximately from the plane indicated by the line 8—8 in FIG. 1.
Figure 9:
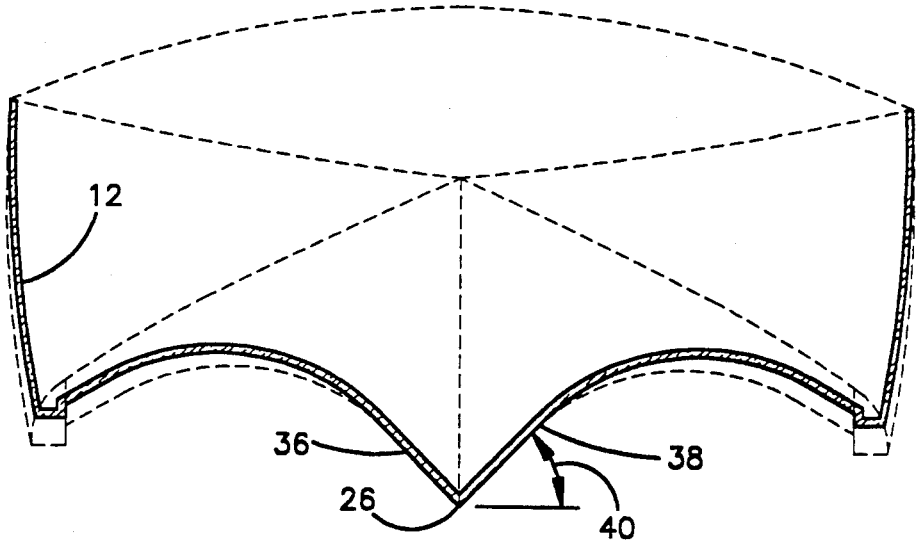
FIG. 9 is a cross sectional view as seen approximately from the plane indicated by the line 9—9 in FIG. 1.

The center sponson 27 has a more extreme V (a narrower taper) than conventional keels. This increases directional stability, and as the speed increases, the boat rises out of the water with a much narrower bottom area submersed, thus dramatically reducing displacement and drag and increasing efficiency at higher speeds. Referring to FIG. 9, the sides 36,38 of the center sponson 27 are constructed to form an angle 40 to the plane of the water, known as the deadrise, within the range of 40–50 degrees (preferably 45 degrees) from the transom 16 forward to the bow peak 34. The angle 40 may vary in the portion of the center sponson 27 extending outside of the water but is constant in the portion below the waterline. Thus, the inside angle of the center sponson 27 is within the range of 80–100 degrees (preferably 90 degrees). Referring to FIG. 7, the depth of the keel 26 as measured from a straight line across the gunwales 18,20 at the midsection of the hull 12 is approximately one-half of the beam.

Figure 10:
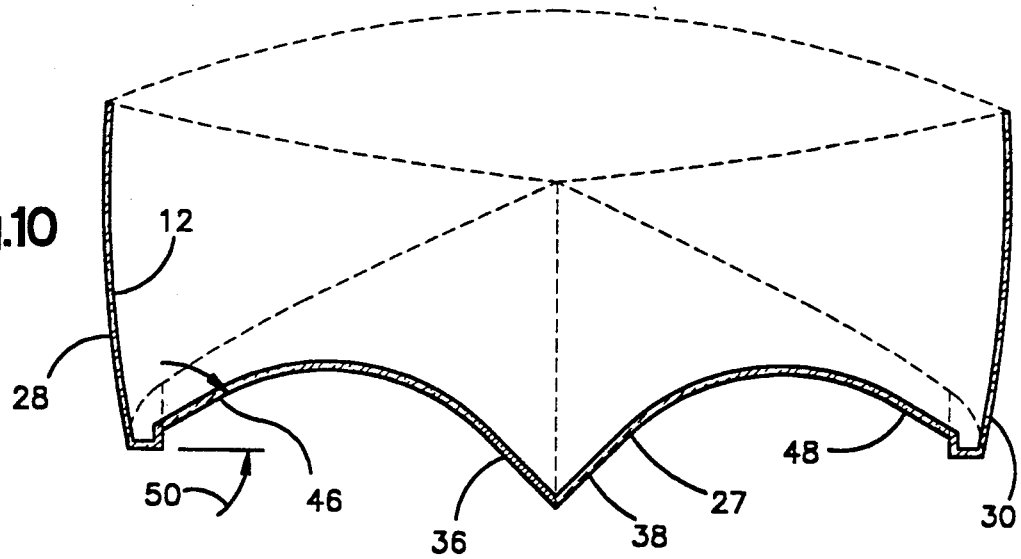
FIG. 10 is a cross sectional view as seen approximately from the plane indicated by the line 10—10 in FIG. 1.
Figure 11:
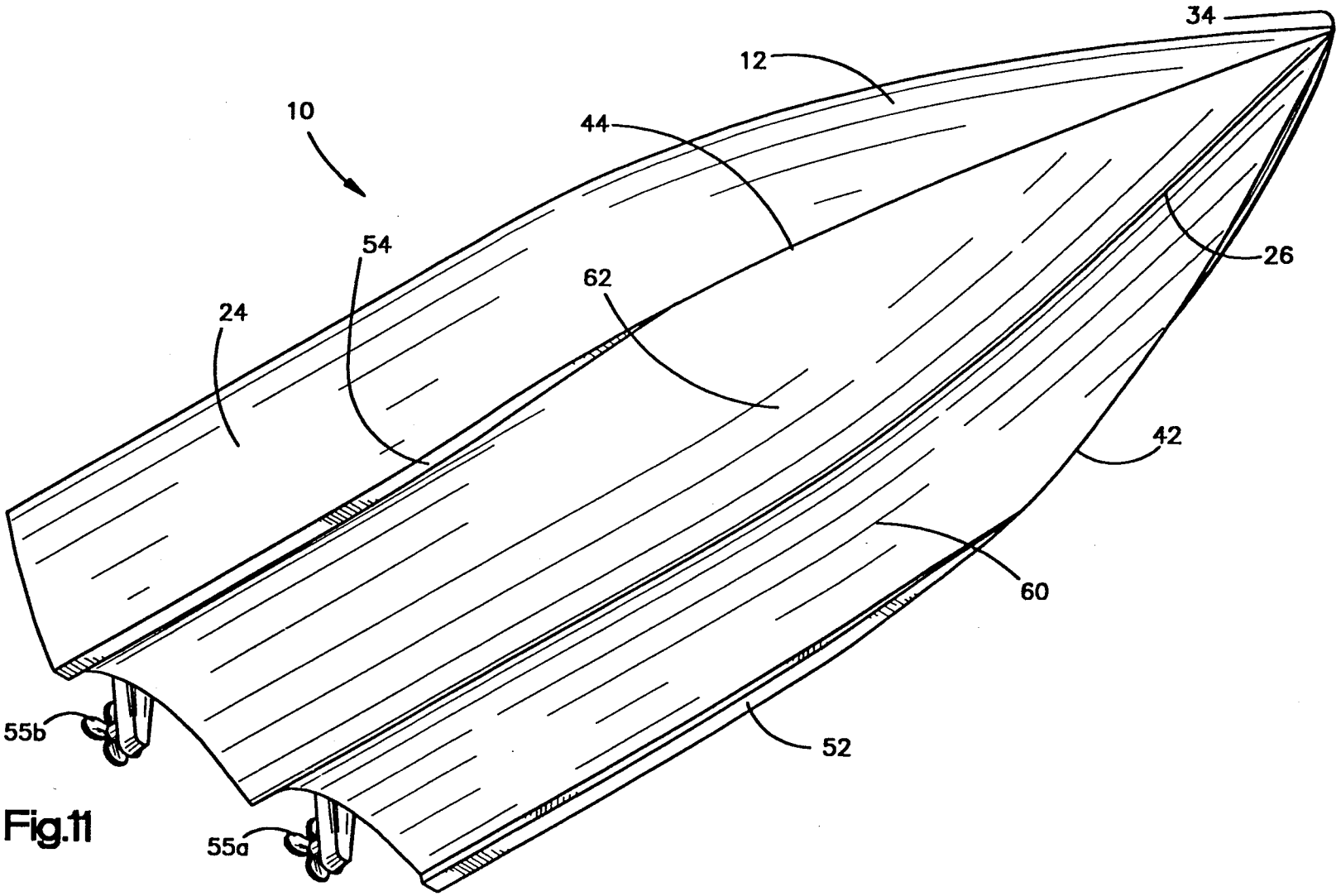
FIG. 11 is a perspective view of the boat of FIG. 1.

The outer sponsons 28,30 provide the boat 10 with stability at all speeds and at rest. As shown in FIGS. 4 and 5, each outer sponson 28,30 is generally V-shaped and includes a chine 42,44 and an inner side wall 46,48. The outside of each outer sponson 28,30 is formed by the boat sides 22,24. Referring to FIG. 10, the inner side walls 46,48 extend laterally from the chines 42,44 at an angle 50 to the plane of the water, or deadrise, within the range of 25–35 degrees (preferably 30 degrees) from the transom to a point approximately where the chines 42,44 extend from the water. In other words, the angle 50 may vary in the portions of the sponsons 28,30 extending outside of the water but is constant in the portions below the waterline.

Figure 6:
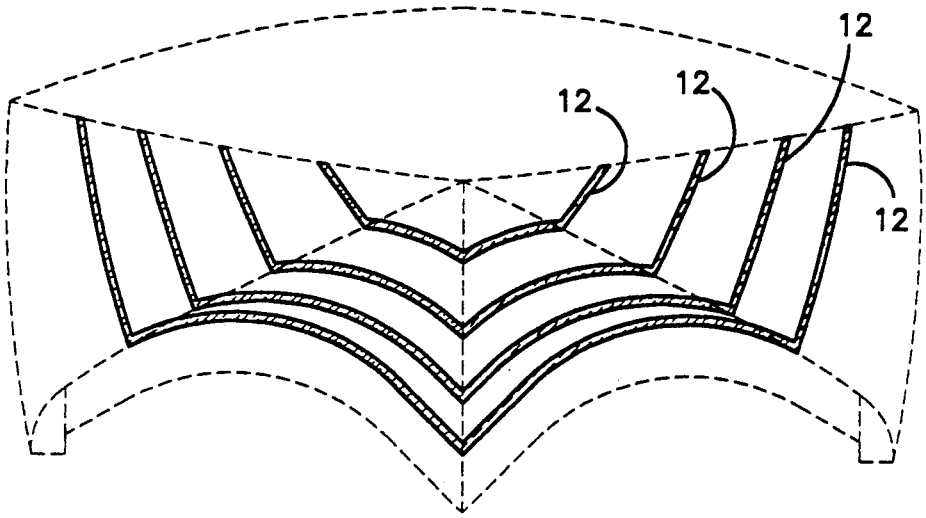
FIG. 6 is a cross sectional view showing the sections seen approximately from the planes indicated by the lines 6—6 in FIG. 1.

Each chine 42,44 is linear from a point just aft of the middle of the hull 12 to the transom 16. From that point forward, as seen in FIGS. 5 and 6, the chines 42,44 slope upwardly toward the bow 14 and inwardly toward the keel 26. Referring to FIG. 3, the chines 42,44 taper from flat portions 52,54 to single edges 56,58 which extend forward to the bow peak 34 where they meet the bottom edge of the keel 32 and the gunwales 18,20 (FIG. 4).

The flat portions 52,54 behave like water skis and provide the boat with lift. At high speeds, most of the hull 12 is lifted otu of the wate thus greatly reducing drag, virtually elminating wake, asnd increasing efficiency. The flat portions 52,54 lift the boat 10 keeping it nearly level. Therefore, the bow 14 does not ride as high as in conventional boats resulting increased aeodynamic efficiency and improved visibility for the operator. In addition, the flat portions 52, 54 reduce the boat's tendency to tilt ot one side during turns. That is, the boat tends to remains substantially level like an automobile during a turn rather than laterally tilting like an airplane. The lifting effect of th eflat portions 52,54 also enable standard propeller drives 55*a,b*, which position the propellers well below the water line at slower speeds, to bring the propellers to the surface, i.e., to be surface piercing, at higher speeds for optimal performance. In the preferred embodiment, the flat portions 52,54 are each approximately one-sixteenth of the beam in width, however, this dimension is variable depending on the desired performance characteristics.

As seen in FIG. 10, the chines 42,44 are higher than the keel 26. The difference between the depth of the keel 26 and the depth of the chines 42,44 at their linear portions is preferably one-eighth of the beam. This ratio may be changed as the design speed of the boat changes. For example, as the design speed of the boat increases, the difference between the depth of the keel 26 and the depth of the chines 42,44 may be decreased. In other words, as the hull 12 rises higher out of the water at higher speeds, it may be desirable to lower the chines 42,44 to maintain the contact of both chines 42,44 with the water.

Between each sponson 28,30 and the keel 26 is an arched tunnel 60,62 extending uninterrupted from the transom to the bow peak 34. The radius of the arches is approximately equal to one-fourth of the beam. The arched surfaces of the tunnels 60,62 provide great strength with a minimal amount of hull material. The twin tunnels 60,62 are believed to create a Bernoulli effect where the high relative velocity between the hull 12 and the air in the tunnels 60,62 at high speeds creates a reduction in the pressure beneath the hull and causes the hull 12 to "stick" to the water. This feature enhances the stability of the boat 10. The air in the tunnels 60,62 also serves to cushion the boat 10 resulting in a more comfortable ride. In the preferred embodiment, a pair of propeller drives 55*a,b* are located at the stern in alignment with the center of each arched tunnel 60,62. This way, the propellers are clear of the stern. The tunnels 60,62 enable the drives to be mounted higher than in conventional boats which dramatically reduces the draft.

The centerlines of the arches of the tunnels 60,62 are linear,parallel to one another, to chines 42,44, to the keel 26, and to the plane of the water between the mid-section of the boat 10 and the transom 16. Referring to FIGS. 5 and 6, between the mid-section of the boat 10 and the bow peak 34, the centerlines of the arches converge towards the bow peak 34 like the chines 42,44.

The hull 12 offers many of the benefits of existing hull designs while eliminating many of their drawbacks. The hull 12 provides the high strength, high load capacity, below deck storage and ability to cut through waves of deep-V hulls due primarily to the central V-shaped center sponson 27. The hull 12 provides reduced drag and high stability of catamaran hulls due primarily to the outer sponsons 28, 30. Additionally, the hull 12 provides the efficiency, stability, high acceleration, lift and level attitude of tunnel hulls due primarily to the twin tunnels 52, 54 and the linear chines 42, 44. The downward slope of the forward part of the deck 13 contributes to the level ride by aerodynamically producing a downward force on the bow 14 at high speeds. During experimental operation, a wooden-hulled boat embodying the present invention equipped with twin 7.4 liter 300 h.p. (224 KW) MERCRUISER (trademark) stern drives accelerated from idle (in gear) to 60 mph (96.5 km/hr) in less than 11 seconds; much more rapid than similarly powered conventional hulled boats. Better results are expected when a fiberglass hull is used.

While a preferred embodiment of this invention has been described in detail, it will be apparent that certain modifications or alterations can be made without departing from the spirit and scope of the invention set forth in the appended claims.

I claim:

1. A boat comprising:

a hull;

a bow having a peak;

a transom;

a pair of gunwales converging at said peak;

a generally V-shaped center sponson having a keel extending from said peak to said transom, wherein said keel is linear between at least a mid-section of the boat and said transom;

a pair of outer sponsons, one to each side of said center sponson, extending from said peak to said transom, each of said outer sponsons including a chine extending from said transom to said peak, said chines converging toward said peak forward of said mid-section of said hull, wherein said chines are linear at least between said mid-section and said transom;

a pair of arched tunnels, one to each side of said keel, said tunnels extending longitudinally between said peak and said transom and laterally between said keel and said chines, wherein said tunnels are parallel and each tunnel has a constant height as measured from said chines to the top of each tunnel from at least said mid-section of the boat to said transom; and wherein the inside angle of the center sponson is within the range of 80–100 degrees between said transom and approximately the location where said keel extends from the water.

2. A boat comprising:

a hull;

a bow at the front of said hull;

a transom at the rear of said hull;

a generally V-shaped center sponson on said hull having a keel extending from said bow to said transom, said keel being linear between a mid-section of said hull and said transom;

a pair of outer sponsons, one to each side of said center sponson, extending from said bow to said transom, said outer sponsons including a pair of chines extending from said transom to a peak of said bow where they converge, said chines being linear and parallel to said keel between said mid-section and said transom;

a pair of arched tunnels, one to each side of said keel, said tunnels extending longitudinally between said bow and said transom and laterally between said keel and said chines, wherein said tunnels are parallel and each tunnel has a constant height as measured from the chines to the top of each tunnel from at least said mid-section of the boat to the transom; and wherein the inside angle of said center sponson is within the range of 80–100 degrees between said transom and approximately the location where said keel extends from the water.

3. A boat comprising:

a hull;

a bow having a peak at the front of said hull;

a transom at the rear of said hull;

a pair of gunwales at the top of said hull converging at said peak;

a generally V-shaped center sponson having a keel extending from said peak to said transom;

a pair of outer sponsons, one to each side of said center sponson, extending between said peak and said transom, said outer sponsons including a pair of chines extending from said transom to said peak where they converge, said chines including a flat portion extending between a mid-portion of said hull and said transom; and a pair of arched tunnels, one to each side of said keel, said tunnels extending longitudinally between said peak and said transom and laterally between said keel and said chines said tunnels having centerlines which are linear and parallel to said chines from said mid-section of said hull to said transom and which converge at said peak.

4. A boat as claimed in claim 3 and further including a pair of propellers mounted on said transom for driving said boat, each propeller having a center axis which is vertically aligned with the chines and horizontally aligned with the center of each tunnel, respectively.

5. A boat comprising:

a hull;

a bow having a peak;

a transom;

a pair of gunwales converging at said peak;

a generally V-shaped center sponson having a keel extending from said peak to said transom, wherein said keel is linear between at least a mid-section of the boat and said transom;

a pair of outer sponsons, one to each side of said center sponson, extending from said peak to said transom, each of said outer sponsons including a chine extending from said transom to said peak, said chines converging toward said peak forward of said mid-section of said hull, wherein said chines are linear at least between said mid-section and said transom;

a pair of arched tunnels, one to each side of said keel, said tunnels extending longitudinally between said peak and said transom and laterally between said keel and said chines, wherein said tunnels are parallel and each tunnel has a constant height as measured from said chines to the top of each tunnel from at least said mid-section of the boat to said transom; and wherein the angle of an inside surface of each outer sponson to the plane of the water is within the range of 25–30 degrees between said transom and a location approximately where said chines extend from the water.

6. A boat comprising:

a hull;

a bow having a peak;

a transom;

a pair of gunwales converging at said peak;

a generally V-shaped center sponson having a keel extending from said peak to said transom, wherein said keel is linear between at least a mid-section of the boat and said transom;

a pair of outer sponsons, one to each side of said center sponson, extending from said peak to said transom, each of said outer sponsons including a chine extending from said transom to said peak, said chines converging toward said peak forward of said mid-section of said hull, wherein said chines are linear at least between said mid-section and said transom;

a pair of arched tunnels, one to each side of said keel, said tunnels extending longitudinally between said peak and said transom and laterally between said keel and said chines, wherein said tunnels are parallel and each tunnel has a constant height as measured from said chines to the top of each tunnel from at least said mid-section of the boat to said transom; and wherein each tunnel has a centerline and said centerlines converge at said peak.

7. A boat comprising:

a hull;

a bow at the front of said hull;

a transom at the rear of said hull;

a generally V-shaped center sponson on said hull having a keel extending from said bow to said transom, said keel being linear between a mid-section of said hull and said transom;

a pair of outer sponsons, one to each side of said center sponson, extending from said bow to said transom, said outer sponsons including a pair of chines extending from said transom to a peak of said bow where they converge, said chines being linear and parallel to said keel between said mid-section and said transom;

a pair of arched tunnels, one to each side of said keel, said tunnels extending longitudinally between said bow and said transom and laterally between said keel and said chines, wherein said tunnels are parallel and each tunnel has a constant height as measured from the chines to the top of each tunnel from at least said mid-section of the boat to the transom; and wherein the angle of an inside surface of each outer sponson to the plane of the water is within the range of 25–30 degrees between said transom and a location approximately where said chines extend from the water.

* * * * *